United States Patent [19]

Postma

[11] Patent Number: 4,536,675

[45] Date of Patent: Aug. 20, 1985

[54] ELECTRODELESS GAS DISCHARGE LAMP HAVING HEAT CONDUCTOR DISPOSED WITHIN MAGNETIC CORE

[75] Inventor: Pieter Postma, Eindhoven, Netherlands

[73] Assignee: U.S. Philips Corporation, New York, N.Y.

[21] Appl. No.: 409,205

[22] Filed: Aug. 18, 1982

[30] Foreign Application Priority Data

Sep. 14, 1981 [NL] Netherlands ..... 8104223

[51] Int. Cl.[3] ..... H01J 1/50; H01J 7/24; H01J 61/52

[52] U.S. Cl. ..... 313/46; 313/161; 313/485; 315/344

[58] Field of Search ..... 313/11, 37, 39, 46, 313/153, 161, 567, 642, 485, 490; 315/248, 344

[56] References Cited

U.S. PATENT DOCUMENTS 4,119,889 10/1978 Hollister ..... 313/116 X
4,298,828 11/1981 Justice et al. ..... 315/248

*Primary Examiner*—David K. Moore
*Assistant Examiner*—K. Wieder
*Attorney, Agent, or Firm*—Robert S. Smith

[57] ABSTRACT

Electrodeless gas discharge lamp having a lamp vessel which is closed in a vacuum-tight manner, the lamp comprising a rod-shaped core of a magnetic material, a member of a heat-conducting material (for example copper) extending at or near the axis of the core, heat generated in the core during operation of the lamp being discharged to the environment of the lamp by the member.

6 Claims, 3 Drawing Figures

ELECTRODELESS GAS DISCHARGE LAMP HAVING HEAT CONDUCTOR DISPOSED WITHIN MAGNETIC CORE

The invention relates to an electrodeless gas discharge lamp having a lamp vessel which is closed in a vacuum-tight manner and is filled with a metal vapor and a rare gas, the lamp comprising a core of a magnetic material in which a radio-frequency magnetic field is induceable by means of an electric supply unit and an electric field is generated, in the lamp vessel. The magnetic material core incorporates a member which is in contact with the core and consists of a heat-conducting material for discharging the heat generated in the core to the environment of the lamp. Such a lamp is disclosed in U.S. Pat. No. 4,017,764.

In the Patent Specification an electrodeless discharge lamp is described having a lamp vessel in which an annular core of magnetic material, such as ferrite, is disposed around which a plurality of wire turns is provided, an electric field then being generated in the lamp vessel.

In response to the discharge the temperature in the magnetic material core increases during operation of the lamp. In addition, the temperature in the core increases due to the occurrence of hysteresis phenomena in the magnetic material. It has been found that the intensity of the phenomena increases as a function of the temperature. There is then the risk that the permeability of the core material is reduced and the efficiency of the lamp decreases. It is conceivable that the lamp will fail.

In order to prevent these unwanted effects from occurring, the United States Patent Specification proposes to provide the outer wall surface of the annular magnetic core (which is fully contained in the lamp vessel) with an annular heat-conducting member, for example consisting of copper or aluminium, the member bearing on the core. This second ring comprises a plurality of small metal rods piercing the wall of the lamp vessel in order to discharge the heat generated in the core to the environment of the lamp. A glass wall having a reflecting layer is provided around the assembly of the magnetic core and the heat-conducting ring in the lamp.

It has been found that with magnetic cores of a shape which deviates from the annular shape (for example cores consisting of a rod as described in U.S. Pat. No. 3,521,120) the effect of a heat conductor located outside the core is minor. It has namely been found that the magnetic flux lines induced in the core during operation of the lamp cross the wall of the heat conductor. The heat-conducting member is then heated considerably by the eddy currents occurring therein, so that the effect of the member is lost for a considerable part.

It is an object of the invention to provide an electrodeless gas discharge lamp of the type described in the opening paragraph in which the heat generated in the magnetic core is rapidly discharged, the negative effects of the prior art construction being avoided.

A lamp according to the invention is therefore characterized in that the magnetic core is in the form of a rod, the member consisting of a heat-conducting material extending along at least the major portion of the core length, at least at or near the longitudinal axis of the core.

In a lamp in accordance with the invention the heat generated in the core is effectively discharged to the environment of the lamp. As a result of the fact that the member extends at least on or near the longitudinal axis of the rod-shaped core, (the dimensions of the member being small in relation to the dimensions of the core) the magnetic field is hardly affected by the member. Namely, the magnetic flux lines close through the core. They hardly run through the member (which consists of, for example, copper or aluminium), the relative magnetic permeability being considerably lower than the permeability of the core (which preferably consists of ferrite). So heating of the member by eddy currents hardly takes place.

In one embodiment the member is in the form of a rod. Such a rod can be provided in a comparatively simple manner in the core. In one specific embodiment the member comprises at least one plate. The magnetic core is then assembled from a plurality of portions which are provided on either side of the plate during manufacture. In a practical embodiment the member consists of two plates which are perpendicular to each other and meet on the longitudinal axis of the core.

The dimensions of the heat-conducting member are small compared with the dimensions of the core. In cross-section the surface area of the member is in practical embodiments approximately 1/5 to 1/30 of the surface area of the core. With a larger heat-conducting surface area (for example more than $\frac{2}{3}$) eddy current losses occur in the heat-conducting member and have a negative effect on the efficiency of the lamp. With a small surface area (for example less than 1/50) the effect of the presence of a heat-conducting member is comparatively low.

The heat generated in the core can be discharged to the environment of the lamp by means of a metal disk connected to one end of the body and extending to the outer circumference of the lamp. The member is preferably connected to a metal jacket which incorporates the electric power supply unit, which metal jacket extends to the exterior of the lamp and is preferably provided with a base for fitting the lamp in a socket for incandescent lamps. This not only effects a proper heat discharge but also the metal jacket serves at the same time as an electric shield for the power supply unit.

Lamps in accordance with the invention have such a luminous flux, shape and color rendering that they are suitable as an alternative to incandescent lamps for general lighting purposes, such as used in, for example, dwelling houses.

Embodiments of an electrodeless gas discharge lamp in accordance with the invention will now be further described by way of example with reference to the accompanying drawing.

In the drawing

Figure 1:
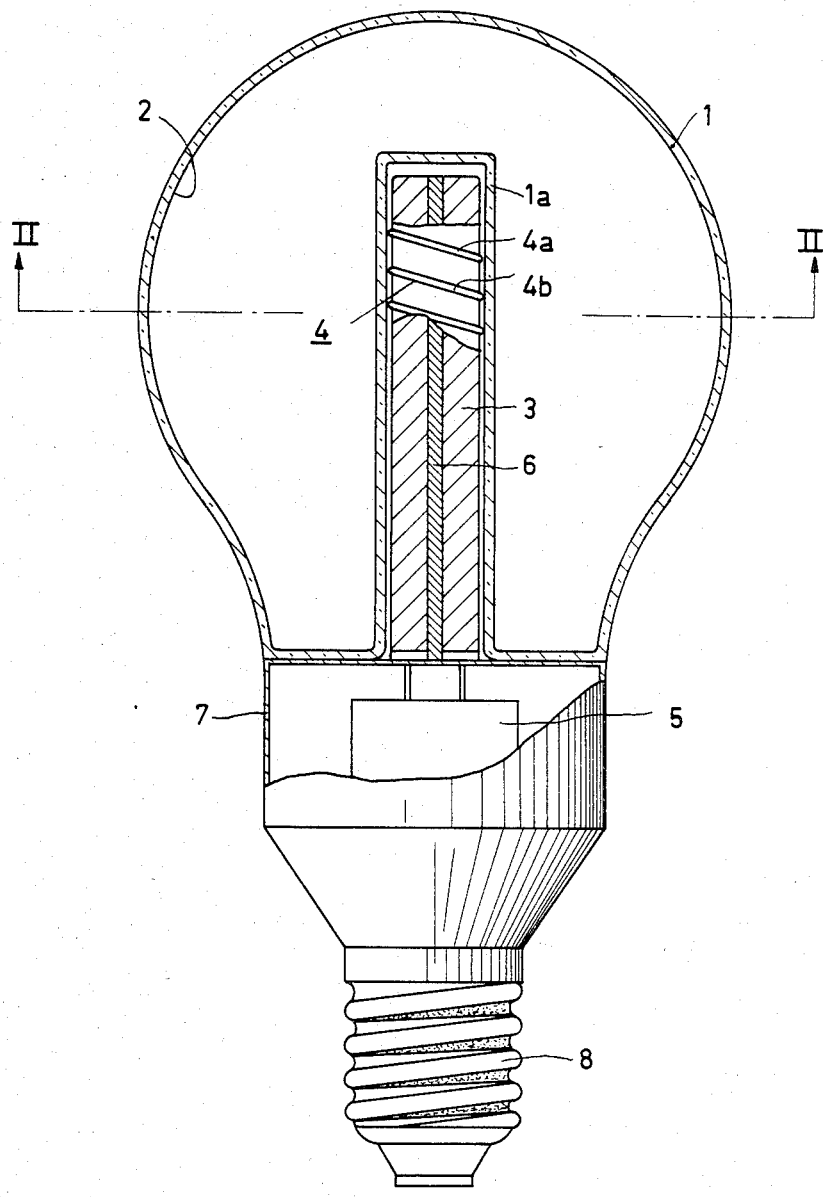
FIG. 1 shows schematically a longitudinal section through a first embodiment of an electrodeless low-pressure mercury vapor discharge lamp.

The lamp shown in FIG. 1 comprises a glass lamp vessel 1 which is closed in a vacuum-tight manner and is filled with a quantity of mercury and a rare gas, for example argon. A luminescent layer 2 which converts the ultraviolet radiation generated in the lamp vessel into visible light is provided on the interior wall surface of the lamp vessel. In addition, the lamp incorporates a (rod-shaped) core 3 of a magnetic material (ferrite), provided in an induction coil 4. The core 3 and the coil 4 are arranged in a recessed portion 1*a* provided in the wall of the lamp vessel 1 near the longitudinal axis of the lamp. The coil 4 has a number of copper wire turns (for example seven) a small number (4*a*, 4*b*) of which are shown in the drawing. The coil 4 is connected to an electric power supply unit 5 by means of which a radio frequency magnetic field is induceable. In this embodiment supply unit 5 is disposed in the lamp. In specific embodiments however said unit 5 may be present outside the lamp. An electric field is then generated inside the lamp vessel 1.

The core 3 contains a rod-shaped member 6 of a heat-conducting material for discharging the heat generated in the core during operation of the lamp. The member 6 extends over the central portion of the core 3 and along its overall length. In a cross-sectional view the surface area of member 6 is approximately 1/25 of the surface area of the ferrite core 3 (see FIG. 2). The member 6 consists of copper having a high thermal conductivity. Along its full length the rod is in an intimate contact with the core wall.

At the bottom side the rod 6 is connected to a metal jacket 7, which also incorporates the electric power supply unit 5. The metal jacket 7 extends to the exterior side of the lamp (in order to discharge heat to the environment of the lamp) and comprises a sleeve 8 for fitting the lamp in a socket intended for incandescent lamps. A layer of electrically insulating material (not shown in the drawing) is provided between the sleeve 8 and the jacket 7.

In a practical embodiment of a lamp as described above the diameter of the glass lamp vessel is approximately 65 mm, its length is approximately 70 mm. Furthermore, the lamp vessel contains mercury (6 mg) and a rare gas (argon) at a pressure of approximately 70 Pascal. The luminescent layer consists of a mixture of two phosphors, namely green-luminescing, terbium-activated cerium magnesium aluminate and red-luminescing, trivalent-europium activated yttrium oxide. The magnetic material of the rod core consists of a ferrite having a relative permeability of approximately 200. ("Philips 4M2" ferrite). An induction coil, consisting of copper wire having a diameter of 0.5 mm, is wound around this ferrite core. The inductance of the coil is approximately 4.5 $\mu$H (seven turns).

The electric power supply unit comprises a radio frequency oscillator having a frequency of approximately 3 MHz. The heat-conducting copper rod (length approximately 50 mm, diameter 2 mm) accurately fits in a hole provided over the longitudinal axis of the core and is in intimate contact with the core. The core has a length of 50 mm and a diameter of 10 mm. The ratio between the surface areas is 1/25.

At an applied power to the lamp of approximately 15 Watt the luminous flux is 900 lumens. The efficiency of the frequency converter in the electric power supply unit is well over 80%. The system efficiency of the lamp in combination with the power supply is approximately 60 lm/W.

Figure 2:
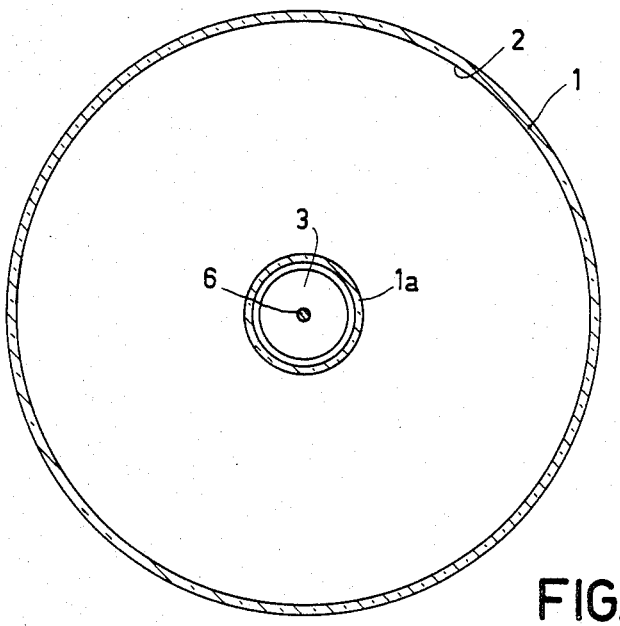
FIG. 2 is a cross-sectional view of the lamp of FIG. 1 along the plane II—II.
Figure 3:
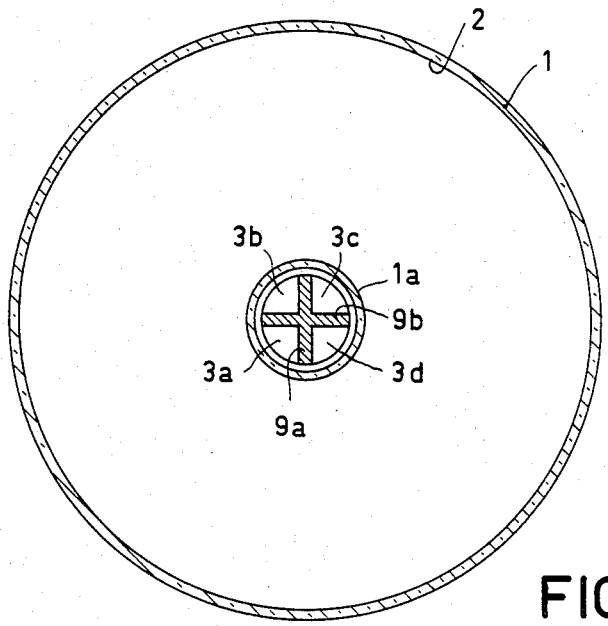
FIG. 3 is a cross-sectional view of a second embodiment of a low-pressure mercury discharge lamp in accordance with the invention.

In FIG. 3 corresponding components are given the same reference numerals as in FIG. 1 and FIG. 2. The heat-conducting member consists of two (copper) plates 9*a* and 9*b* which are arranged substantially perpendicularly to each other and cross on the longitudinal axis of the core of the lamp. The plates (approximately 0.8 mm thick in a practical embodiment) extend to the core circumference. The core is assembled from four elongate portions 3*a* to 3*d*, inclusive, which bear on the said plates and are connected thereto. It has been found that a proper heat discharge was accomplished during operation of the lamp, there being hardly any heating of the plates by eddy currents.

What is claimed is:

1. An electrodeless gas discharge lamp having a lamp vessel which is closed in a vacuum-tight manner and is filled with a metal vapor and a rare gas, the lamp comprising a core of a magnetic material in which a radio frequency magnetic field is induceable by means of an electric power supply unit, an electric field being generated in the lamp vessel, the magnetic material core incorporating a member which is disposed within and is in contact with the core and consists of a heat-conducting material for discharging the heat generated during operation of the lamp to the environment of the lamp, characterized in that the core is in the form of a rod, the member extending along at least the major portion of the core length at least at or near the longitudinal axis of the core.

2. An electrodeless gas discharge lamp as claimed in claim 1, characterized in that the member is rod-shaped.

3. An electrodeless gas discharge lamp as claimed in claim 1, characterized in that the member comprises at least one plate.

4. An electrodeless gas discharge lamp as claimed in claim 1, 2 or 3, characterized in that the member is connected to a metal jacket incorporating the electric power supply unit, the jacket extending to the exterior side of the lamp.

5. An electrodeless gas discharge lamp as claimed in claim 1, 2, or 3 characterized in that the member contains copper.

6. An electrodeless gas discharge lamp as claimed in claim 4, characterized in that the member contains copper.

* * * * *